US005788546A

United States Patent [19]

Ogino

[11] Patent Number: 5,788,546

[45] Date of Patent: Aug. 4, 1998

[54] SHIFT ASSISTOR FOR MARINE TRANSMISSION

[75] Inventor: Hiroshi Ogino, Hamamatsu, Japan

[73] Assignee: Sanshin Kogyo Kabushiki Kaisha, Japan

[21] Appl. No.: 681,121

[22] Filed: Jul. 22, 1996

[30] Foreign Application Priority Data

Jul. 20, 1995 [JP] Japan ..... 7-207466

[51] Int. Cl.[6] ..... B63H 20/20

[52] U.S. Cl. ..... 440/75; 440/80

[58] Field of Search ..... 440/80, 81, 75; 416/128, 129; 192/51, 21; 74/378

[56] References Cited

U.S. PATENT DOCUMENTS

| | | | |
|---|---|---|---|
| 4,302,196 | 11/1981 | Blanchard . | |
| 4,530,667 | 7/1985 | McCormick | 440/75 |
| 4,793,773 | 12/1988 | Kinouchi et al. . | |
| 4,986,774 | 1/1991 | Wantz . | |
| 5,006,084 | 4/1991 | Handa . | |
| 5,449,306 | 9/1995 | Nakayasu et al. . | |
| 5,522,703 | 6/1996 | Okamoto . | |
| 5,575,698 | 11/1996 | Ogino . | |

FOREIGN PATENT DOCUMENTS

| | | | |
|---|---|---|---|
| 529448 | 8/1956 | Canada | 440/81 |
| 1309890 | 12/1989 | Japan . | |
| 6-156382 | 6/1994 | Japan | 440/75 |
| 7-117793 | 5/1995 | Japan . | |
| 7-149293 | 6/1995 | Japan . | |
| 2152164 | 7/1985 | United Kingdom . | |

*Primary Examiner*—Sherman Basinger
*Attorney, Agent, or Firm*—Knobbe, Martens, Olson & Bear, LLP

[57] ABSTRACT

A transmission for a dual, counter-rotational propeller system incorporates a shift assistor to yieldably cushion transmission engagement. The shift assistor desirably operates between one clutch of a dual clutch assembly and a clutch actuator. The shift assistor specifically yieldably couples the clutch to the actuator. The yieldably coupling permits relative movement between the shift assistor and the clutch during the shifting operation in order to allow the clutches to engage the corresponding gears separately (i.e., at different times). The shift assistor thus reduces coupling shock when shifting the transmission either into a forward or a reverse drive condition.

10 Claims, 10 Drawing Sheets

SHIFT ASSISTOR FOR MARINE TRANSMISSION

BACKGROUND OF THE INVENTION

1. Field of the Invention

The present invention relates to a marine drive, and in particular to a transmission for a marine drive.

2. Description of Related Art

Many marine propulsion systems now employ a counter-rotating propeller system. Front and rear propellers of the system, which are of opposite hand and which rotate in opposite directions about a common axis, together produce a forward driving thrust. The dual propeller arrangement provides improved propulsion efficiency and enhances the handling characteristics of the watercraft. Such propulsion systems are common in both outboard motors and in stern drive units of inboard/outboard motors.

Marine drives commonly employ forward/neutral/reverse-type transmissions with dual, counter-rotating propeller systems. These transmissions typically include a driving pinion and a pair of oppositely rotating driven bevel gears that are journaled within a lower unit of the marine drive. A front dog clutch sleeve of a dual clutch assembly selectively couples an inner propeller shaft to one of the driven bevel gears to rotate the rear propeller in either rotational direction to establish a forward or a reverse drive condition. A rear dog clutch sleeve of the clutch assembly also selectively couples an outer propulsion shaft to the rear driven bevel gear to rotate the outer propeller shaft and the front propeller in the forward drive direction.

An actuator actuates the clutches. In a conventional transmission, the actuator simultaneously engages the front dog clutch sleeve and the front gear, as well as the rear dog clutch sleeve and the rear gear to establish a forward drive condition. A conventional actuator involves a plunger actuated by a cam. A spring acting on an opposite end of the plunger from the cam forces the plunger to follow the cam. The spring forces the front clutch to engage the front gear and the rear clutch to engage the rear gear. To disengage the clutches and to engage the front clutch with the rear gear, the cam forces the plunger and clutches out of engagement and moves the front clutch into engagement with the rear gear.

Several drawbacks are associated with conventional transmissions of the type described above. Simultaneous engagement of the clutches requires synchronized registration of both the teeth of the front clutch and the front gear, and the teeth of the rear clutch and the rear gear. The teeth of the gears and clutches are not static, however, and synchronization of the teeth is not a constant condition. Under most conditions, the teeth of the clutches and gears are out of phase. Thus, engagement may not be instantaneous, and may not be as quick as a watercraft operator would like.

Additionally, the simultaneous engagement of the front and rear clutches with the respective gears produces a large mechanical shock on the transmission. The mechanical shock accelerates fatigue and wears the transmission components, as well as the other components of the outboard drive.

In addition, the simultaneous coupling of the front and rear clutches with their respective gears tends to generate a discomforting noise. A portion of the mechanical shock mentioned above is a result of the instantaneous coupling of the clutch and gears, which before engagement usually rotate at differing speeds. The instantaneous load applied to the transmission when the clutches engage the gears often produces a discomforting noise.

SUMMARY OF THE INVENTION

In view of the foregoing drawbacks and shortcomings of the prior shifting mechanism, a need exists for a shifting mechanism which reduces the shock caused by clutch engagement with the gears, and consistently and quickly shifts between drive conditions, either from forward to reverse or from reverse to forward.

One aspect of the present invention thus involves a transmission for a watercraft outboard drive which selectively couples a drive shaft of the outboard drive to first and second propulsion shafts. Each propulsion shaft extends from the transmission to drive a propulsion device. The transmission comprises first and second counter-rotating gears which are driven by the drive shaft. A first clutch is connected to the first propulsion shaft on a side of the first and second gears opposite of the propulsion devices. A second clutch is connected to the second propulsion shaft and is interposed between the first and second gears. A shift plunger interconnects the first and second clutches and a shift assistor yieldably connects the second clutch to the shift plunger. The yieldably coupling permits relative movement between the shift plunger and the clutch during the shifting operation in order to allow the clutches to separately engage the respective gears.

Another aspect of the present invention involves a transmission for a watercraft outboard drive which selectively couples a drive shaft of the outboard drive to first and second propulsion shafts. Each propulsion shaft extends from the transmission to drive a propulsion device. The transmission comprises first and second counter-rotating gears which are driven by the drive shaft. A first clutch is connected to the first propulsion shaft on a side of the first and second gears opposite of the propulsion devices. A second clutch is connected to the second propulsion shaft and is interposed between the first and second gears. The first and second clutches move in a first direction to couple the first and second clutches with the first and second gears respectively. The clutches also move in an opposite second direction to couple the second clutch with the first gear. Means also is provided for yieldingly coupling the first and second clutches together in both the first and the second directions.

BRIEF DESCRIPTION OF THE DRAWINGS

These and other features of the invention will now be described with reference to the drawings of preferred embodiments of the present transmission. The illustrated embodiments of the transmission are intended to illustrate, but not to limit the invention. The drawings contain the following figures.

DETAILED DESCRIPTION OF PREFERRED EMBODIMENTS

Figure 1:
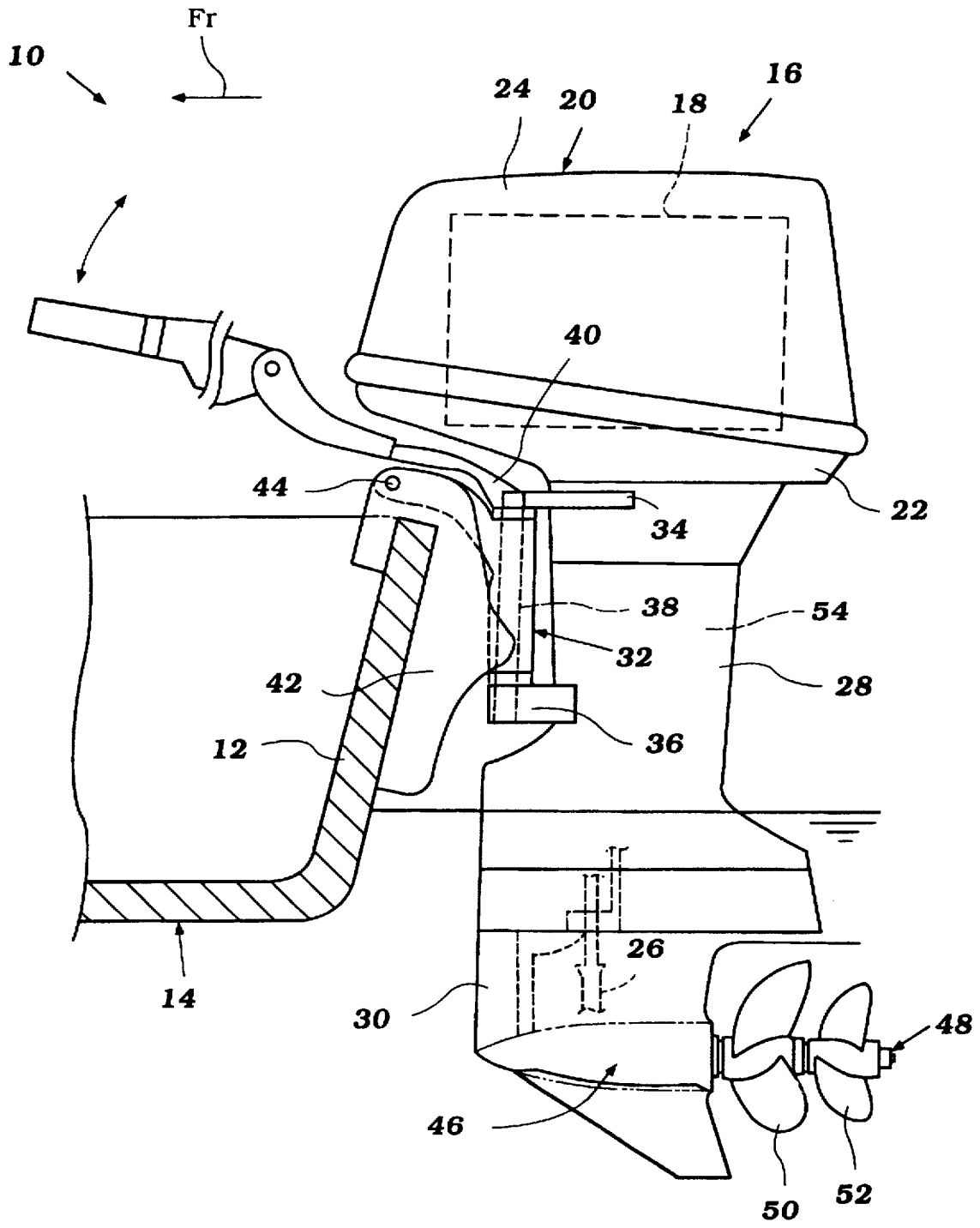
FIG. 1 is a side elevational view of an outboard motor which incorporates a transmission that is configured in accordance with a preferred embodiment of the present invention.

FIG. 1 illustrates a marine drive 10 configured in accordance with the preferred embodiment of the present invention. In the illustrated embodiment, the marine drive 10 is depicted as an outboard motor for mounting on a transom 12 of the watercraft 14. It is contemplated, however, that those skilled in the art will readily appreciate that the present invention can be applied to stern drive units of inboard/outboard motors, and to other types of watercraft drive units, as well. Thus, as used herein, "outboard drive" generically means outboard motors, stern drives, and similar marine drive units. Additionally, "front" and "rear" are used herein in reference to the transom 12 of the watercraft 14.

In the illustrated embodiment, the outboard motor 10 has a power head 16 which desirably includes an internal combustion engine 18. The internal combustion engine 18 can have any number of cylinders and cylinder arrangements, and can operate on a variety of known combustion principles (e.g., on a two-stroke or a four-stroke principle).

A protective cowling assembly 20 surrounds the engine 18. The cowling assembly 20 includes a lower tray 22 and a top cowling 24. The tray 22 and the cowling 24 together define a compartment which houses the engine 18 with the lower tray 22 encircling a lower portion of the engine 18.

The engine 18 is mounted conventionally with its output shaft (i.e., a crankshaft) rotating about a generally vertical axis. The crankshaft (not shown) drives a drive shaft 26, as known in the art. The drive shaft 26 depends from the power head 16 of the outboard motor 10.

A drive shaft housing 28 extends downwardly from the lower tray 20 and terminates in a lower unit 30. The drive shaft 26 extends through the drive shaft housing 28 and is suitably journaled therein for rotation about the vertical axis.

A conventional steering shaft assembly 32 is affixed to the drive shaft housing 28 by upper and lower brackets 34, 36. The brackets 34, 36 support the steering shaft assembly 32 for steering movement. Steering movement occurs about a generally vertical steering axis which extends through a steering shaft 38 of the steering shaft assembly 32. A steering arm 40, which is connected to an upper end of the steering shaft 38, can extend in a forward direction for manual steering of the outboard motor 10, as known in the art.

The steering shaft assembly 32 also is pivotably connected to a clamping bracket 42 by a pin 44. This convention coupling permits the outboard motor 10 to be pivoted relative to the pin 44 to permit adjustment of the trim position of the outboard motor 10 and for tilt-up of the outboard motor 10.

Although not illustrated, it is understood that a conventional hydraulic tilt-and-trim cylinder assembly, as well as a conventional steering cylinder assembly, can be used as well with the present outboard motor 10. The construction of the steering and trim mechanisms is considered to be conventional, and for that reason, further description is not believed necessary for an appreciation or understanding of the present invention.

Figure 2:
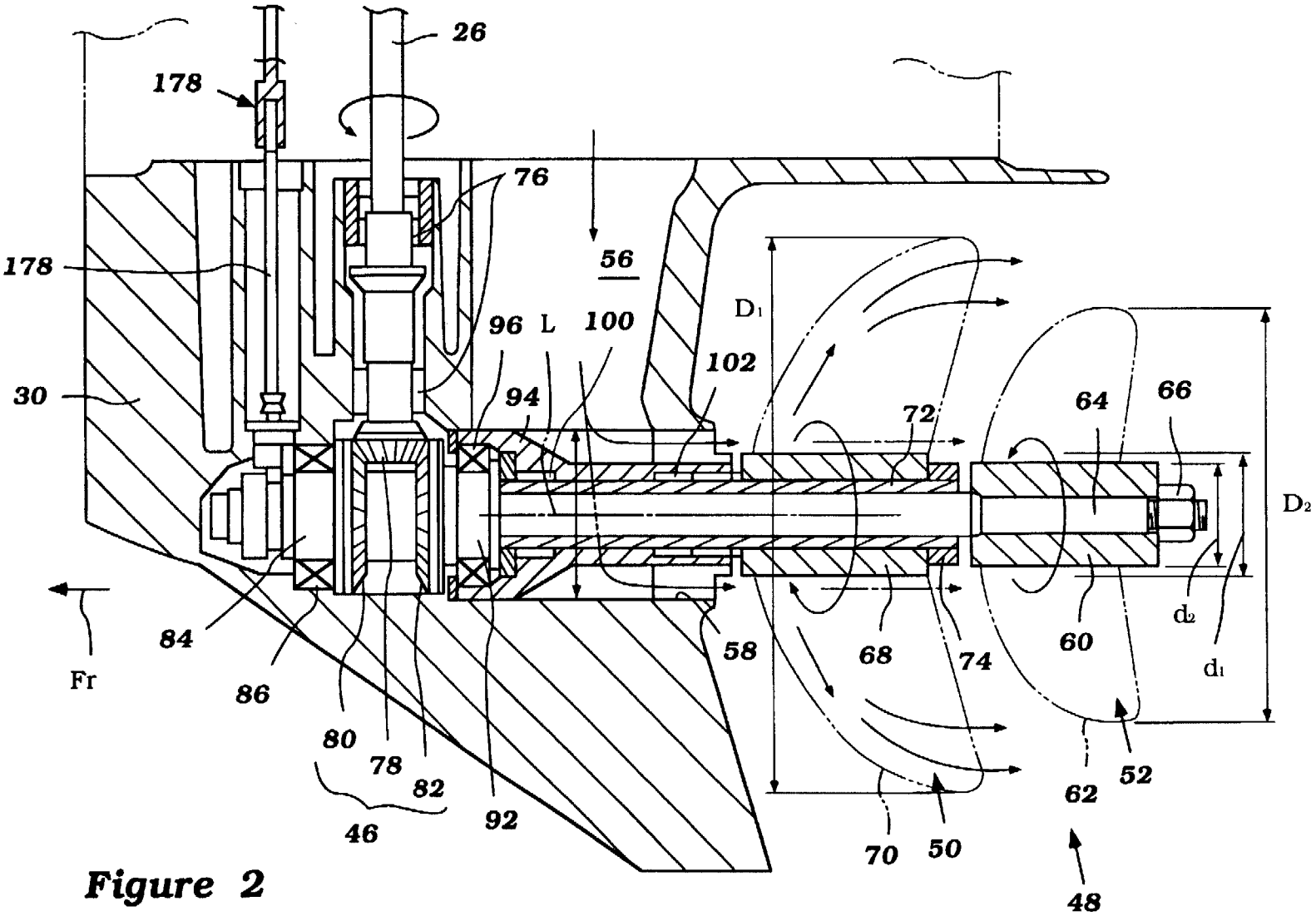
FIG. 2 is a sectional, side elevational view of a lower unit of the outboard motor of FIG. 1 illustrating the transmission and a propulsion device of the outboard motor which includes a propulsion shaft assembly.

With reference to FIGS. 1 and 2, the drive shaft 26 continues from the drive shaft housing 28 into the lower unit 30, where it drives a transmission 46. The transmission 46 selectively establishes a driving condition of a propulsion device 48, which can take the form of a propeller, a hydrodynamic jet, or like propulsion device. The transmission 46 advantageously is a forward/neutral/reverse-type transmission. In this manner, the propulsion device 48 can drive the watercraft 14 in any of these three operational states.

The present transmission 46 is particularly well suited for use with a counter-rotating propulsion device 48. The counter-rotating propulsion device 48, which is illustrated in FIGS. 1 and 2, includes a front propeller 50 designed to spin in one direction and to assert a forward thrust, and a rear propeller 52 which is designed to spin in an opposite direction and to assert a forward thrust. The propellers 50, 52 thus are of opposite hand. The construction of the propellers will be described below.

An exhaust system discharges engine exhaust from an engine manifold of the engine 18. The engine manifold of the engine 18 communicates with an exhaust conduit formed within an exhaust guide positioned at the upper end of the drive shaft housing 28. The exhaust conduit of the exhaust guide opens into an expansion chamber 54. The expansion chamber 54 is formed within the drive shaft housing 28 and communications with a discharge conduit 56 (see FIG. 2) formed within the lower unit 30. The discharge conduit 56 terminates at a discharge end 58 formed on the rear side of the lower unit 30. In this manner, engine exhaust is discharged into the water in which the watercraft 14 is operating and in the vicinity of the propellers 50, 52 to produce a cavitation effect about the front propeller 50 to thereby improve acceleration from low speeds, as described below.

FIG. 2 illustrates the components of the front and rear propellers 50, 52. The rear propeller includes a hub 60 to which propeller blades 62 are integrally attached. An inner propulsion shaft 64 drives the rear propeller hub 60. For this purpose, a spline connection connects the propeller hub 60 to the inner propulsion shaft 64. The hub 60 is fixed onto the rear end of the inner propulsion shaft 64 between a retaining nut 66 secured onto the rear end of the inner shaft 64 and a step in diameter of the inner shaft 64.

The front propeller 50 likewise includes a propeller hub 68. Propeller blades 70 are integrally formed on the exterior of the hub 68. As seen in FIG. 2, the hub 68 of the front propeller 50 has a larger diameter $d_1$ than the diameter $d_2$ of the rear propeller hub 60. Likewise, the propeller diameter $D_1$ of the front propeller 50 is larger than the propeller diameter $D_2$ of the rear propeller 52.

An outer propulsion shaft 72 carries the front propeller 50. The rear end of the outer propulsion shaft 72 carries the propeller hub 68 and drives the propeller hub 68 thereabouts by a spline connection. The hub 68 is secured onto the outer propulsion shaft 72 between an annular retaining ring 74 and a thrust washer that is positioned adjacent to the lower unit 30.

In the illustrated embodiment, the outer propulsion shaft 74 has a tubular shape. The inner propulsion shaft 64 extends through the outer propulsion shaft 74. The shafts 64, 72 desirably are coaxial and rotate about a common longitudinal axis L.

The individual components of the present transmission 46 will now be described in detail with reference to FIGS. 2–4. As seen in FIG. 2, the lower end of the drive shaft 26 is suitably journaled within the lower unit 30 by a pair of bearing assemblies 76. At its lower end, the drive shaft 26 carries a drive gear or pinion 78 which forms a portion of the transmission 46. The pinion 78 preferably is a beveltype gear.

The transmission 46 also includes a pair of counter-rotating driven gears 80, 82 that are in mesh engagement with the pinion 78. The pair of driven gears 80, 82 preferably are positioned on diametrically opposite sides of the pinion 78, and are suitably journaled within the lower unit 30, as described below. Each driven gear 80, 82 is positioned at about a 90° shaft angle with the drive shaft 26. That is, the propulsion shafts 68, 72 and the drive shaft 26 desirably intersect at about a 90° shaft angle; however, it is contemplated that the drive shaft 26 and the propulsion shafts 64, 72 can intersect at almost any angle.

In the illustrated embodiment, the pair of driven gears 80, 82 are a front bevel gear 80 and an opposing rear bevel gear 82. The front bevel gear includes a hub 84 which is journaled within the lower unit 30 by a front thrust bearing 86. The thrust bearing 86 rotatably supports the front gear 80 in mesh engagement with the pinion 78.

Figure 3:
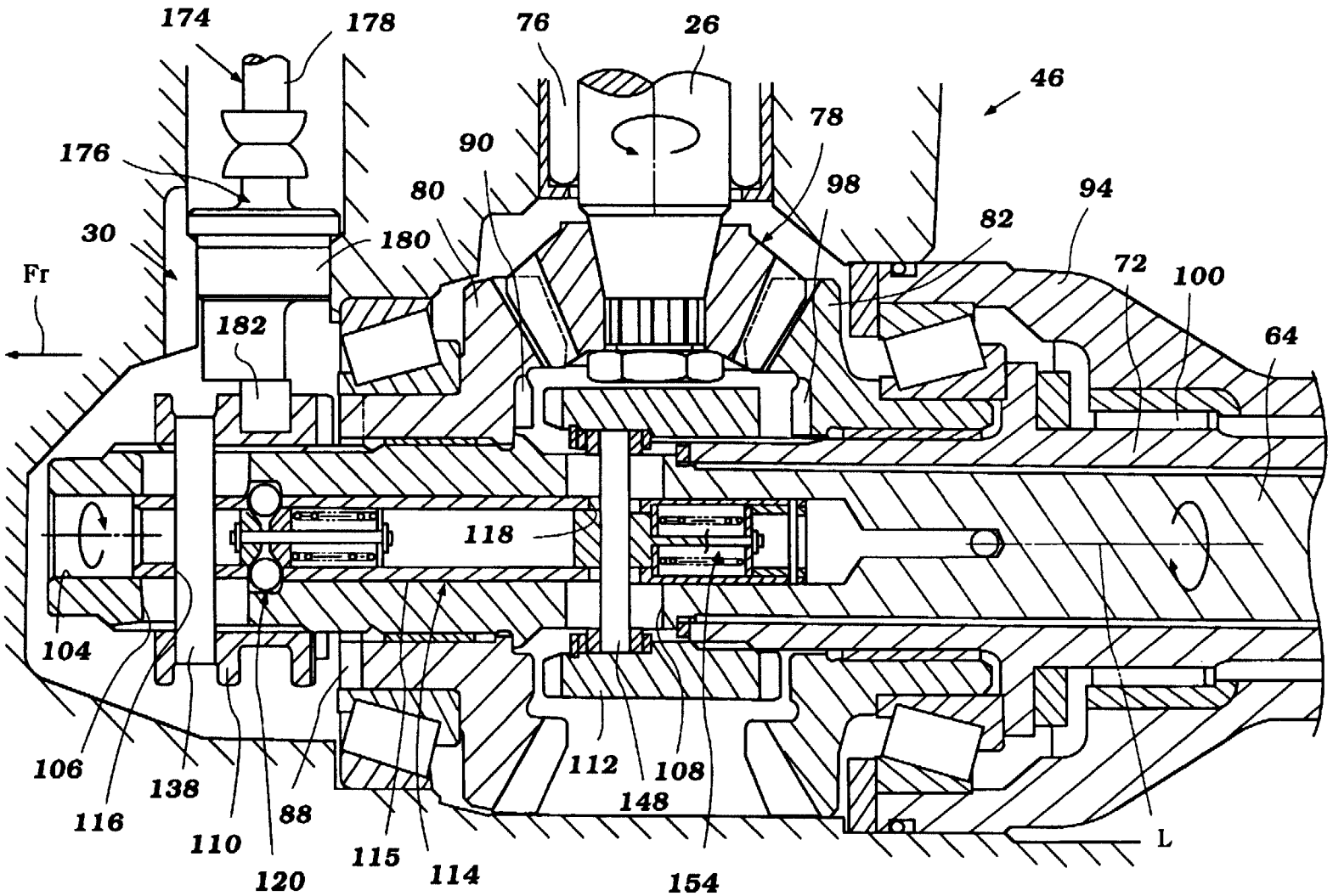
FIG. 3 is an enlarged sectional, side elevational view of the transmission and the propulsion shaft assembly.
Figure 4:
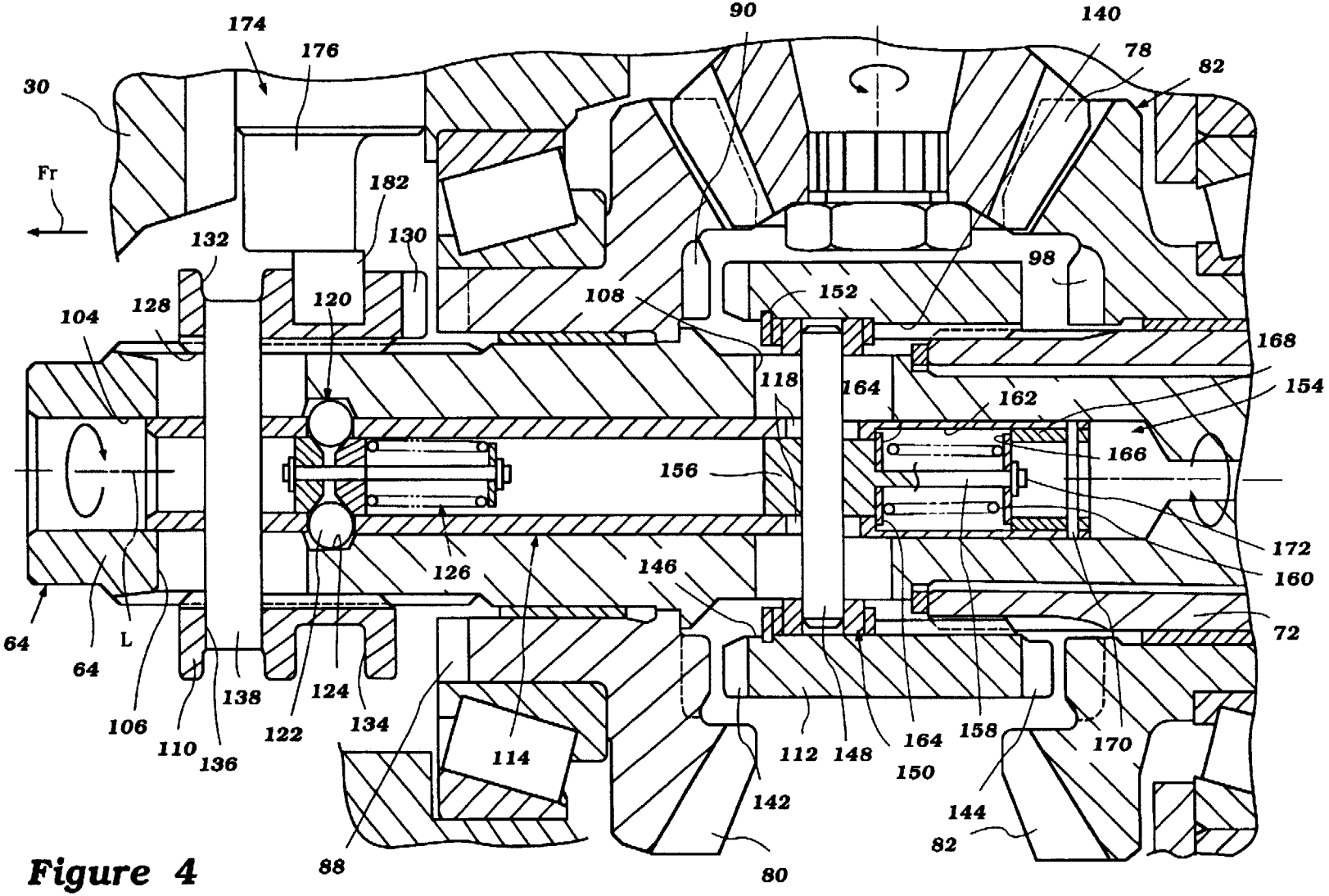
FIG. 4 is an enlarged sectional, side elevational view of the transmission of FIG. 3 with the transmission under a neutral operational condition.

As seen in FIGS. 3 and 4, the hub 84 has a center bore through which the inner propulsion shaft 64 passes. The inner propulsion shaft 64 is suitably journaled within the central bore of the front gear hub 84.

The front gear 80 also includes a series of teeth 88 on an annular front-facing engagement surface, and includes a series of teeth 90 on an annular rear-facing engagement surface. The teeth 88, 90 on each surface positively engage a portion of a clutch of the transmission 46, as described below.

The rear gear 82 also includes a hub 92 which is suitably journaled within a bearing carrier 94 by a rear thrust bearing 96. The rear thrust bearing rotatably supports the rear gear 82 in mesh engagement with the pinion 78.

The hub 92 of the rear gear 82 has a central bore through which the inner propulsion shaft 64 and the outer propulsion shaft 72 pass. The rear gear 82 also includes an annular front engagement surface which carries a series of teeth 98 for positive engagement with a clutch of the transmission 46, as described below.

As best seen in FIGS. 2 and 3, the bearing carrier 94 rotatably supports the hollow outer propulsion shaft 72 within the lower unit 30. A front needle bearing 100 journals the front end of the outer propulsion shaft 72 within the bearing carrier 94. A rear needle bearing 102 supports the outer propulsion shaft 72 within the bearing carrier 94 at an opposite end of the bearing carrier 94 from the front needle bearing 100.

As best seen in FIG. 3, the inner propulsion shaft 64 extends through the front gear hub 84 and the rear gear hub 92 and is suitable journaled therein. On the rear side of the rear gear 82, the inner propulsion shaft 62 extends through the outer propulsion shaft 72 and is suitable journaled therein.

As seen in FIG. 3, the front end of the inner propulsion shaft 64 includes a longitudinal bore 104. The bore 104 extends from the front end of the inner shaft 64 to a point within the hub 92 of the rear gear 82. The longitudinal bore 104 communicates with lubricant passages within the inner shaft 64 positioned at the rear end of the longitudinal bore 104. A front aperture 106 extends through the inner shaft 64, transverse to the axis of the longitudinal bore 104, at a position forward of the front bevel gear 80. The inner shaft also includes a rear aperture 108 that extends transversely to the longitudinal axis L of the inner shaft and is generally symmetrically positioned between the front bevel gear 80 and the rear bevel gear 82.

As seen in FIG. 3, the transmission 46 also includes a front clutch 110 and a rear clutch 112 coupled to a plunger 114. As discussed in detail below, the front clutch 110 selectively couples the inner propulsion shaft 64 to the front gear 80. The rear clutch 112 selectively couples the outer propulsion shaft 72 either to the front gear 80 or to the rear gear 82. FIG. 3 illustrates the front clutch 110 and the rear clutch 112 set in a neutral position (i.e., in a position in which the clutches 110, 112 do not engage either the front gear 80 or the rear gear 82). In the illustrated embodiment, the clutches 110, 112 are positive clutches, such as, for example, dog clutch sleeves; however, it is contemplated that the present transmission 46 could be designed with friction-type clutches.

The plunger 114 includes a generally cylindrical rod-shape body 115 and slides within the longitudinal bore 104 of the inner shaft 64 to actuate the clutches 110, 112. The plunger 114 desirably is hollow (i.e., is a cylindrical tube).

The plunger 114 includes a front hole 116 that is positioned generally transverse to the longitudinal axis of the plunger 114 and a rear slot 118 that is likewise positioned generally transverse to the longitudinal axis of the plunger 114. The hole 116 and the slot 118 desirably are each located symmetrically in relation to the corresponding apertures 106, 108 of the inner propulsion shaft 64, with the plunger 114 set in the neutral position.

The transmission 46 also includes a neutral detent mechanism 120 to hold the plunger 114 (and the coupled clutches 110, 112) in the neutral position. The neutral detent mechanism 120 operates between the plunger 114 and the inner propulsion shaft 64, and is located toward the front end of the inner propulsion shaft 62.

As best seen in FIG. 4, the neutral detent mechanism is formed in part by at least one and preferably two transversely positioned holes in the plunger 114. These holes receive detent balls 122. The detent balls 122 each have a diameter which is slightly smaller than the diameter of each hole.

The inner propulsion shaft 64 includes an annular groove 124 which is formed on the inner wall of the bore 104 through which the plunger 114 slides. The groove 124 is positioned within the bore 104 so as to properly locate the clutches 110, 112 in the neutral position when the detent holes of the plunger 114 coincide with the axial position of the annular groove 124. A spring plunger 126, formed in part by a helical compression spring, biases the detent balls 122 radially outwardly against the inner wall of the inner propulsion shaft bore 104. The plunger 114 contains the spring plunger 126 within its tubular body 115.

The spring plunger 126 forces portions of the detent balls 122 into the annular groove 124 when the plunger 114 is moved into the neutral position. This releasable engagement between the detent balls 124 carried by the plunger 114 and the annular groove 124 of the inner propulsion shaft 64 releasably restrains movement of the plunger 114 relative to the inner propulsion shaft 64, as known in the art. Because the detent mechanism 120 is believed to be conventional, further description of the detent mechanism 120 is thought unnecessary for an understanding of the present transmission 46.

As seen in FIG. 4, the front dog clutch 110 has a generally cylindrical shape that includes an axial bore 128. The bore 128 extends through an annular front end and a flat annular rear end of the clutch 110. The bore 128 is sized to receive the inner propulsion shaft 64. Internal splines are formed on the wall of the axial bore 128. The internal splines mate with external spines formed on the front end of the inner propulsion shaft 64. The resulting spline connection establishes a driving connection between the front clutch 110 to the inner propulsion shaft 64, while permits the clutch 110 to slide along the front end of shaft 110.

The annular rear end surface of the clutch 110 lies generally transverse to the longitudinal axis L of the inner propulsion shaft 64. The rear surface of the front dog clutch 110 also is substantially coextensive in the area with the annular front surface of the front gear 80. Teeth 130 extend from the clutch rear surface in the longitudinal direction and desirably corresponds with the teeth 88 on the front surface of the front driven gear 80, both in size (i.e., axial length), in number, and in configuration.

A pair of annular grooves circumscribe the exterior of the front clutch 110. A front groove 132 is sized to receive a retaining spring, as described below. The rear groove 134 is sized to cooperate with an actuator mechanism, which will be described below.

The front clutch also includes a traverse hole 136 that extends through the clutch 110 at the location of the front annular groove 132. The hole 136 is sized to receive a pin 138 which, when passed through the front aperture 106 of the inner propulsion shaft 64 and through the front hole 116 of the plunger 114, interconnects the plunger 114 and the front clutch 110 with the front clutch 110 positioned on the inner propulsion shaft 64. The pin 138 may be held in place by a press-fit connection between the pin 128 and the front hole 136, or by a conventional coil spring (not shown) which is contained within the front annular groove 132 about the exterior of the front clutch 110.

The rear clutch 112 is disposed between the two counter-rotating driven gears 80, 82. The rear clutch 112 has a tubular shape that includes an axial bore 140 which extends between an annular front end and an annular rear end. The bore 140 is sized to receive a portion of the outer propulsion shaft 72, which is positioned about the inner propulsion shaft 64.

The annular end surfaces of the rear clutch 112 are substantially coextensive in size with the annular engagement surfaces of the front and rear gears 80, 82, respectively. Teeth 142 extend from the front end of the rear clutch 112 and desirably correspond to the respective teeth 90 of the front gear 80 in size (e.g., axial length), in number, and in configuration. Teeth 144 likewise extend from the rear end surface of the rear clutch 112 and desirably correspond to the respective teeth 98 of the rear gear 82 in size (e.g., axial length), in number, and in configuration.

The front engagement end of the rear clutch 112 advantageously carries a greater number of teeth 142 than the rear engagement end of the rear clutch 112 and a greater number teeth than the front clutch 110. In the illustrated embodiment, the front clutch 110 and the rear engagement end of the rear clutch 112 desirably include the same number of clutching teeth 130, 144, respectively. The front engagement end of the rear clutch 112 desirably includes twice as many teeth 142 as the number of teeth on the rear engagement end of the rear clutch 112. In this manner, the torque load per tooth 142 when the rear clutch 112 engages the front gear 80 is about the same as the torque load per tooth 130, 144 when the front clutch 110 engages the front gear 80 and the rear clutch 112 engages the rear gear 82, even though the entire torque transmitted by the drive shaft 56 is being transmitted to the outer propulsion shaft 72 through the rear clutch 112. In addition, the fewer number of teeth involved where the clutches 110, 112 simultaneously engage the gears 80, 82 eases shifting, because registration between the corresponding teeth is achieved quicker.

A spline connection couples the rear clutch 112 to the outer propulsion shaft 72. The clutch 112 thus drives the outer propulsion shaft 72 through the spline connection, yet the clutch 112 can slide along the front end of the shaft 72 between the front and rear gears 80, 82.

As seen in FIG. 4, the rear clutch 112 also includes a counterbore 146. The counterbore 146 is sized to receive a coupling pin 148 which extends through the rear aperture 108 of the inner propulsion shaft 64 and through the rear slot 118 of the plunger 114. The pin 148 has a diameter smaller than the length of the slot 118. In the illustrated embodiment, the diameter of the pin 148 is about half that of the length of the slot 118.

The ends of the pin 148 desirably are captured by an annular bushing 150 which is interposed between a pair of roller bearings. The assembly of the bushings and bearings is captured between a pair of washers and locked within the counterbore 146 of the rear dog clutch 118 by a retainer ring 152. The roller bearings journal the assembly of the bushing 150 and the pin 148 within the counterbore 146 to allow the bushing 150 and the pin 148 to rotate in an opposite direction from the rear clutch 112. The pin 148, being captured within the counterbore 146 of the rear clutch 112, however, couples the plunger 114 to the rear clutch 112 in order for the plunger 114 to actuate the rear clutch 112, as described below.

A shift assisting mechanism 154 operates between the pin 148 and the plunger 114 to permit the front clutch 110 to engage before the rear clutch 112. It is understood, however, that the shift assistor 154 could alternatively be used in connection with the front clutch 110. Use of the shift assistor 154 with the rear clutch 112 permits some yielding upon engagement of the rear clutch 112 with the gears 80, 82 so as to protect the clutching mechanism as well as cushion the engagement when shifting into either the forward or reverse drive condition.

The shift assistor 154 is disposed at the rear end of the plunger 114, within an inner bore of the hollow plunger 114. The shift assistor includes a cylindrical member or piston 156 which is slidably supported within the inner bore of the hollow plunger 114 on either side on the rear hole 118. A rod 158, which is integrally formed with the cylindrical member 156, extends rearwardly, in the longitudinal direction, through a helical compression spring 160.

The spring 160 is contained within a counterbore 162 that extends into the hollow plunger 114 from the rear end. A front washer 164 and a rear washer 166 sandwich the spring 160 in a preloaded condition.

The front washer 164 rests against a bottom step formed by the counterbore 162 and has an inner diameter larger than a diameter of the rod 158. The rod 158 thus passes freely through the front washer 164.

The rear washer 166 likewise has an inner diameter larger than the diameter of the rod 158 such that the rod extends freely through the rear washer 162. The outer diameters of the front and rear washers 164, 166 desirable match that of the counterbore 162.

An inner sleeve 168 secures and positions the rear washer 166 within the counterbore 162. The sleeve 168 has an outer diameter substantially equal to the diameter of the counterbore 162, and has an inner diameter larger than the outer diameter of the rear washer 166. A pin 170, which passes through aligned transverse holes in the plunger 114 and the inner sleeve 128, affixes the inner sleeve 128 within the counterbore 162 of the plunger 114.

A conventional e-ring 172 is attached to the rear end of the rod 158 to prevent the rod 158 from sliding through the rear washer 166. The e-ring 172 fits within an annular groove (not shown) that circumscribes the rod 158 near its rear end.

The shift assistor mechanism 154 supports the pin 148 in a manner which permits the cylindrical member 156—and thus the pin 148—to move either forwardly or rearwardly relative to the plunger 114. For this purpose, the cylindrical member 156 positions the pin 148 generally at the middle of the rear aperture 108 of the inner propulsion shaft, as well as in the center of the slot 118 of the plunger 114. This yieldably connection permits relative movement between the clutch 112 and the plunger 114 to allow the clutches 110, 112 to engage separately (i.e., at different times) the corresponding gears 80, 82, as well as to cushion the coupling shock when engagement occurs.

With reference to FIGS. 3 and 4, an actuator mechanism 174 moves the plunger 114 of the clutch assembly from a position establishing a forward drive condition, in which the front and rear clutches 110, 112 engage the front and rear gears 80, 82, respectively, through a position of non-engagement (i.e., the neutral position), and to a position establishing a reverse drive condition, in which the rear clutch 112 engages the front gear 110. The actuator mechanism 174 positively reciprocates the plunger 114 between these positions.

The actuator mechanism 174 includes a cam member 176 that connects the front clutch 110 to a rotatable shift rod 178. In the illustrated embodiment, the shift rod 178 is journaled for rotation in the lower unit 30 and extends upwardly to a transmission actuator mechanism (not shown) positioned within the outboard motor cowling 20. The actuator mechanism 174 converts rotational movement of the shift rod 178 into linear movement of the front clutch 110 to move the front clutch 110, as well as the plunger 114 and the rear clutch 112, along the axis L of the propulsion shaft 64, 72.

The cam member 176 is affixed to a lower end of the shift rod 178. The cam member 176 includes an eccentrically positioned drive pin (not shown) which extends downwardly from the cam member 176. The cam member also includes a cylindrical upper portion 180 which is positioned to rotate about the axis of the shift rod 178 and is journaled within the lower unit 30.

A follower 182 of the actuator mechanism generally has a rectangular block-like shape with a retention arm (not shown) depending from one end. The retention arm advantageously depends from the leading edge of the follower 182 relative to the designed rotation of the clutch 110. The retention arm holds the follower 182 on the clutch with the follower 182 captured between the clutch 110 in the rear groove 134 and the lower end of the cam member 176.

The follower also includes a slot which is formed on the upper side of the following member. The slot has a width generally equal to the diameter of the drive pin of the cam member 176. The drive pin extends into the slot of the follower 182 and is captured between the walls of the follower 182.

The follower has a width generally equal to the width of the rear annular groove 134 of the front clutch 110. The height of the follower also generally matches the distance between the lower end of the cam member 176 and the base of the rear groove 134. In this matter, the rear groove 134 receives and captures the follower 182 of the actuator mechanism 174.

The drive pin of the cam member 176 moves both axially and transversely with rotation of the cam member 176 because of the eccentric position of the drive pin relative to the rotational axis of the cam member 176. The aperture of the follower 182 thus desirably has a sufficient length to accommodate the transverse travel of the drive pin as the cam member 176 rotates between positions corresponding to the forward and reverse drive conditions. The axial travel of the drive pin causes the follower 182 and the coupled clutch 110 to move axially, sliding over the inner propulsion shaft 64, as discussed in detail below.

The front clutch 110 thus is coupled to the cam member 176 with the follower 182 cradled between the walls of the rear annual groove 134 on the front clutch 110. The actuator mechanism 74 configured accordingly positively moves the front clutch 110 along the axis of the inner propulsion shaft 64 with rotational movement of the cam member 176 operated by the shift rod 178. The coupling between the actuator mechanism 174 and the front clutch 110, however, allows the front clutch 110 to rotate with the inner propulsion shaft 64 relative to the follower 182 and the cam member 176.

As noted above, the pin 138 connects the front clutch 110 to the plunger 114. This coupling causes the plunger 114 to rotate with the front clutch 110 and the inner propulsion shaft 64. The coupling also conveys the axial movement of the clutch 110 driven by the actuator mechanism 174 to the plunger 114. The plunger 114 consequently moves the rear clutch 112 through the assistance of the shift assistor 154 which travels with the plunger 114.

The following elaborates on a previous description of the operation of the present transmission 46. FIG. 4 illustrates the front and rear clutches 110, 112 in the neutral position, i.e., a position of non-engagement with the gears 80, 82. The detent mechanism 120 maintains the plunger 114 and the coupled clutches 110, 112 in this position.

To establish a forward drive condition, the shift rod 178 rotates the cam member 176 in a manner which moves the drive pin of the cam member 176 axially in the reverse direction. In the illustrated embodiment, clockwise rotation of the shift rod 178 moves the drive pin axially in the rearward direction. The follower 182 thus follows the drive pin to slide the front clutch 110 over the inner propulsion shaft 64. The actuator mechanism 174 thereby forces the front clutch 110 into engagement with the front gear 80, with the corresponding clutch teeth 88, 130 mating. So engaged, the front gear 80 drives the inner propulsion shaft 64 through the internal spline connection between the clutch 110 and the inner propulsion shaft 64. The inner propulsion shaft 64 thus drives the rear propeller 52 in a first direction which asserts a forward thrust.

The forward motion of the clutch 110 also causes the plunger 114 to slide within the longitudinal bore 108 of the inner propulsion shaft in the reverse direction due to the direct coupling of the drive pin 138. The plunger 114 moves the rear coupling pin 148 in the rearward direction to force the rear clutch 112 into engagement with the rear gear 82 with the corresponding teeth 98, 144 mating.

Simultaneous engagement of the front clutch 110 and the rear clutch 112 seldom occurs. Simultaneous engagement of the clutches 110, 112 require synchronized registration between both the teeth of the front clutch 110 and the front gear 80, and the teeth of the rear clutch 112 and the rear gear 82. The teeth of the gears 80, 82 and the clutches 110, 112 are not static, however, and synchronization of the teeth is not a constant condition. Under most conditions, the teeth of the clutches 110, 112 and the gears 80, 82 are out of phase. The present shift assistor mechanism 154 allows the front clutch 110 to engage the front gear 82 without the rear clutch 112 engaging the rear gear 82.

Figure 5:
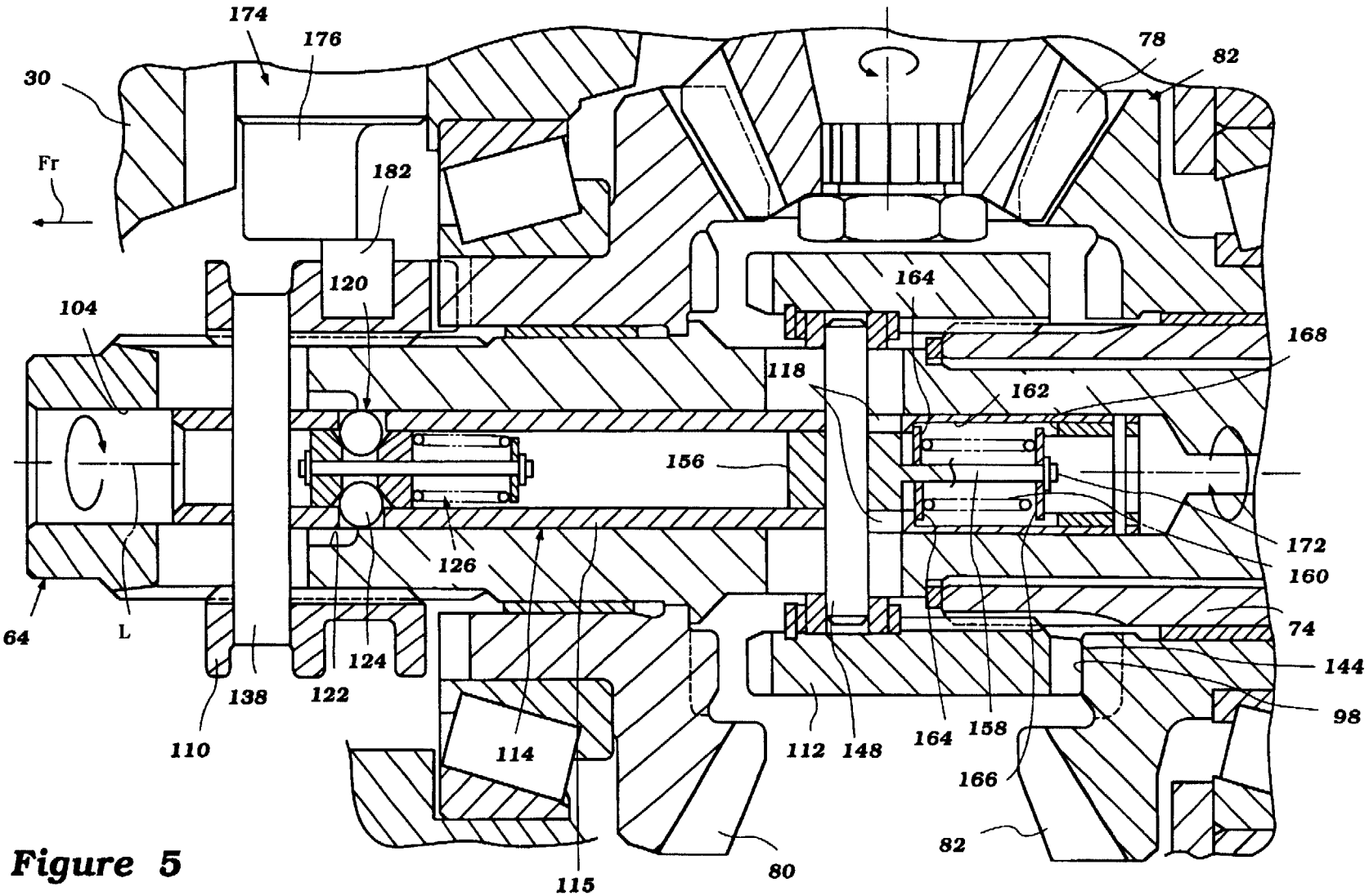
FIG. 5 is a sectional, side elevational view of the transmission of FIG. 4 with the transmission under an intermediate operational state between the neutral operational condition and a forward drive condition.

As seen in FIG. 5, the actuator mechanism 174 can move the front clutch 110 into engagement with the front gear 80. Although the engagement also forces the plunger 114 in the rearward direction, the shift assistor mechanism 154 allows the rear clutch 112 to yield if the teeth 144 of the rear clutch 112 initially clash with the teeth 198 of the rear gear 82. As seen in FIG. 5, the shift assistor 154 allows the plunger 114 to move rearwardly without moving the rear clutch 112. This motion causes the plunger 114 to move relative to the pin 148 with the pin 148 moving to the forward end of the slot 118 in the plunger 114. The corresponding motion of the cylindrical member 156 of the shift assistor 154 compresses the spring 160. The front end of the spring 160 is set while the rear end of the spring 160 moves forward with the spring 160 being compressed by the forwardly moving rear plate 166. The shift assistor 154 consequently urges the rear clutch 112 into engagement with the rear gear 82.

Figure 6:
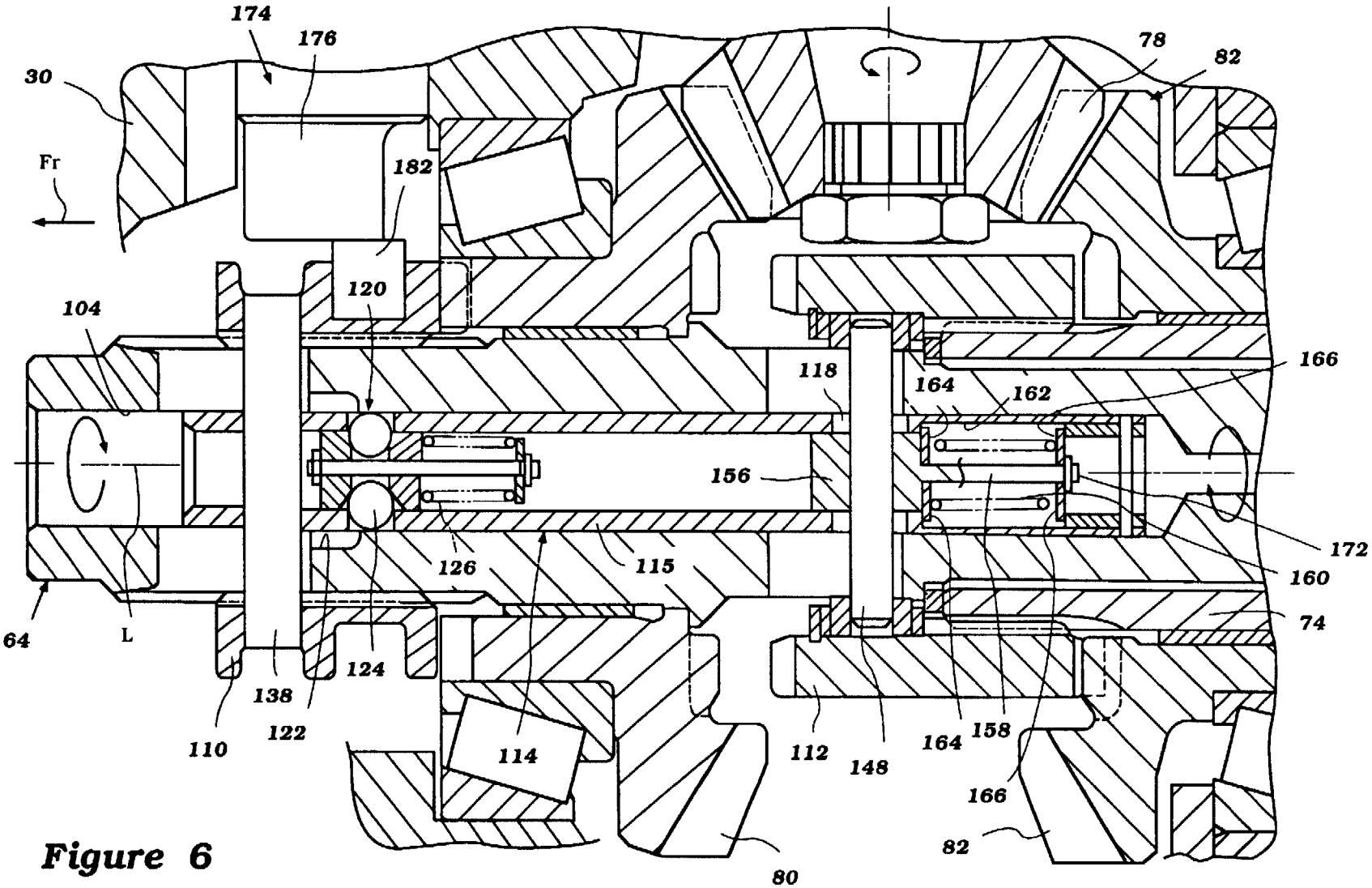
FIG. 6 is a sectional, side elevational view of the transmission of FIG. 5 with the transmission in the forward drive condition.

With reference to FIG. 6, once the teeth 144 of the rear gear 112 register with the teeth 98 of the rear gear 82, the shift assistor 154 forces the rear clutch 112 into engagement with the rear gear 82. So engaged, the rear gear 82 drives the outer propulsion shaft 72 through the spline connection between the rear clutch 112 and the outer propulsion shaft 72. The outer propulsion shaft 72 thus drives the front propeller 50 (FIG. 2) to spin in an opposite direction to that of the rear propeller 52 and to assert a forward thrust.

The dual propeller drive 48 in its forward drive mode provides good propulsion efficiency and minimizes drag under normal running conditions. At low propeller speeds, exhaust gas is discharged in front of the front propeller 50 and aerates the water around the propeller blades 70. As schematically illustrated in FIG. 2, the action of the blades 70 of the propeller 50 drive the exhaust gases outwardly away from the hub 68 of the front propeller 50. The exhaust gases flow over the back of the propeller blades 70 to become entrained in the water stream through the propeller 50.

Aeration or cavitation produced by the entrained exhaust gases within the water decrease the viscosity of the water around the blades 70 of the front propeller 50 to reduce resistance on the blades 70. This permits the propeller 50 to accelerate more quickly. Less propeller resistance, in turn, reduces the load applied by the front propeller 50 on the engine 18, and more power is available to drive the rear propeller 52. The outboard motor 10, consequently, accelerates quicker.

Water speed over the front propeller 50 increases with rising engine and propeller speeds. Under these conditions, as also schematically illustrated in FIG. 2, the exhaust gases tend to flow over the hubs 60, 68 of the front and rear propellers 50, 52 and have less effect on cavitation. The speed of the exhaust gases, as well as the speed of the water flow through the propellers 50, 52, carries the gases through the front and rear propellers 50, 52 in the vicinity of the bases of the propeller blades 62, 70. As a result, discharge of exhaust gases forward of the propellers 50, 52 causes no significant loss of propulsion efficiency when traveling at high speeds. The exhaust gases, thus, generally create a cavitation effect primarily during acceleration.

With reference back to FIG. 4, to establish a reverse drive condition, the shift rod 178 rotates in an opposite direction so as to move the cam member 176 and the eccentrically positioned drive pin in a direction which moves the drive pin axially in the forward direction. Again, in the illustrated embodiment, clockwise rotation of the shift rod 178 rotates the drive pin so as to move the drive pin axially in the forward direction. The forward movement of the drive pin is transferred to the front clutch 110 through the follower 182. This motion also is transferred to the plunger 114 through the clutch 110 and the corresponding coupling pin 138. The forward motion of the plunger 114 positively forces the rear clutch 112 into engagement with the front gear 80 with the corresponding clutching teeth 90, 142 mating.

Figure 7:
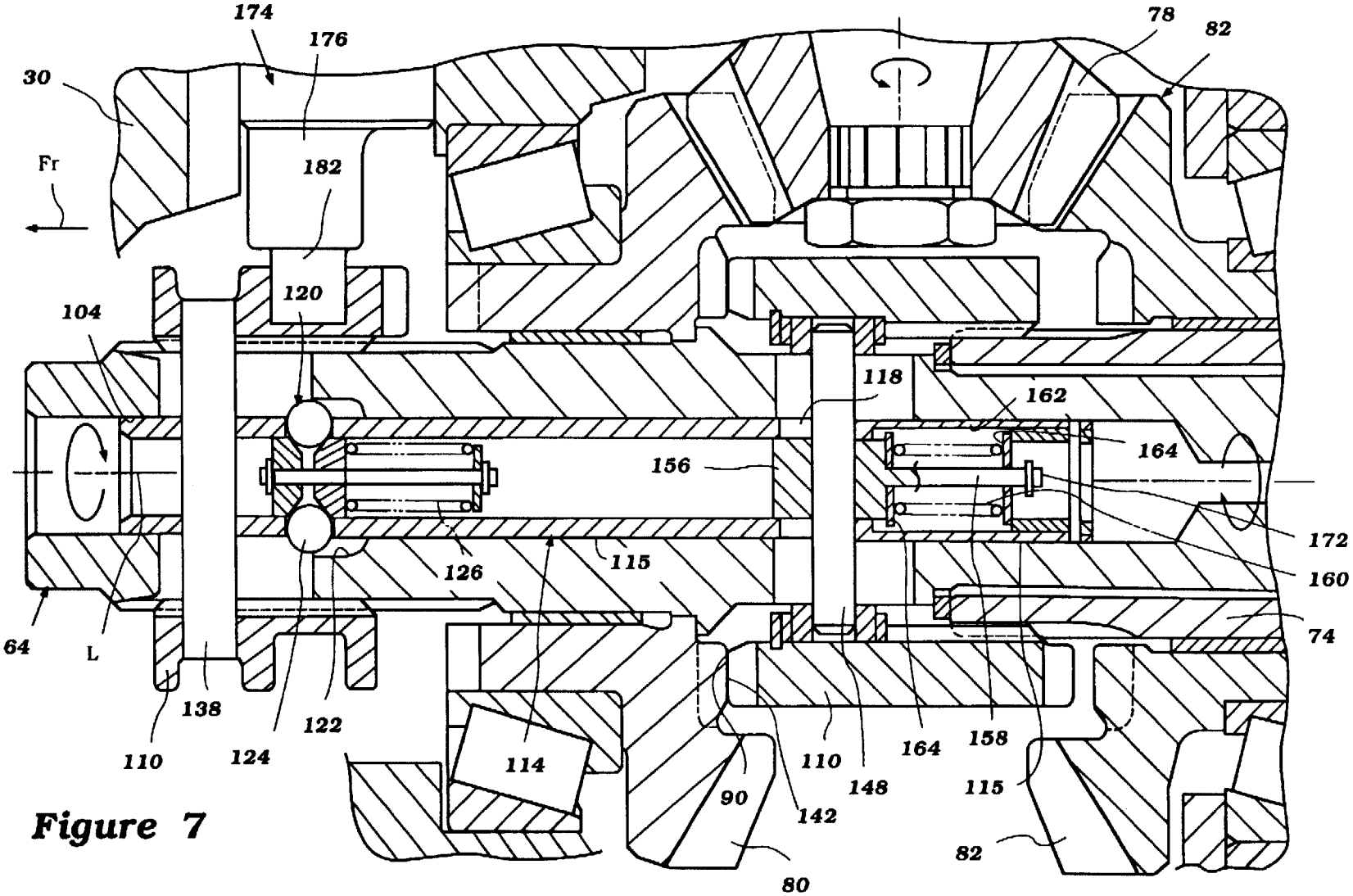
FIG. 7 is a sectional, side elevational view of the transmission of FIG. 4 with the transmission under an intermediate operational state between the neutral operational condition and a reverse drive condition.

As understood from FIG. 7, if the rear clutch teeth 142 initially do not register with the teeth 90 of the front gear 80, the shift assistor 154 allows relative movement between the plunger 114 and the rear clutch 112. The coupling pin 148 thus slides within the slot 118 of the plunger 114. The corresponding movement of the cylindrical member 156 of the shift actuator 154 compresses the spring 160 between the front and rear washers 164, 166. The rear end of the spring 160 is set while the front end of the spring 160 moves rearwardly, with the spring 160 being compressed by the rearwardly moving front plate 164. The compressed spring 160 biases the cylindrical member 156 and coupling pin 148, as well as the coupled rear clutch 112, in the forward direction, thereby urging the rear clutch 112 into engagement with the front gear 80.

Figure 8:
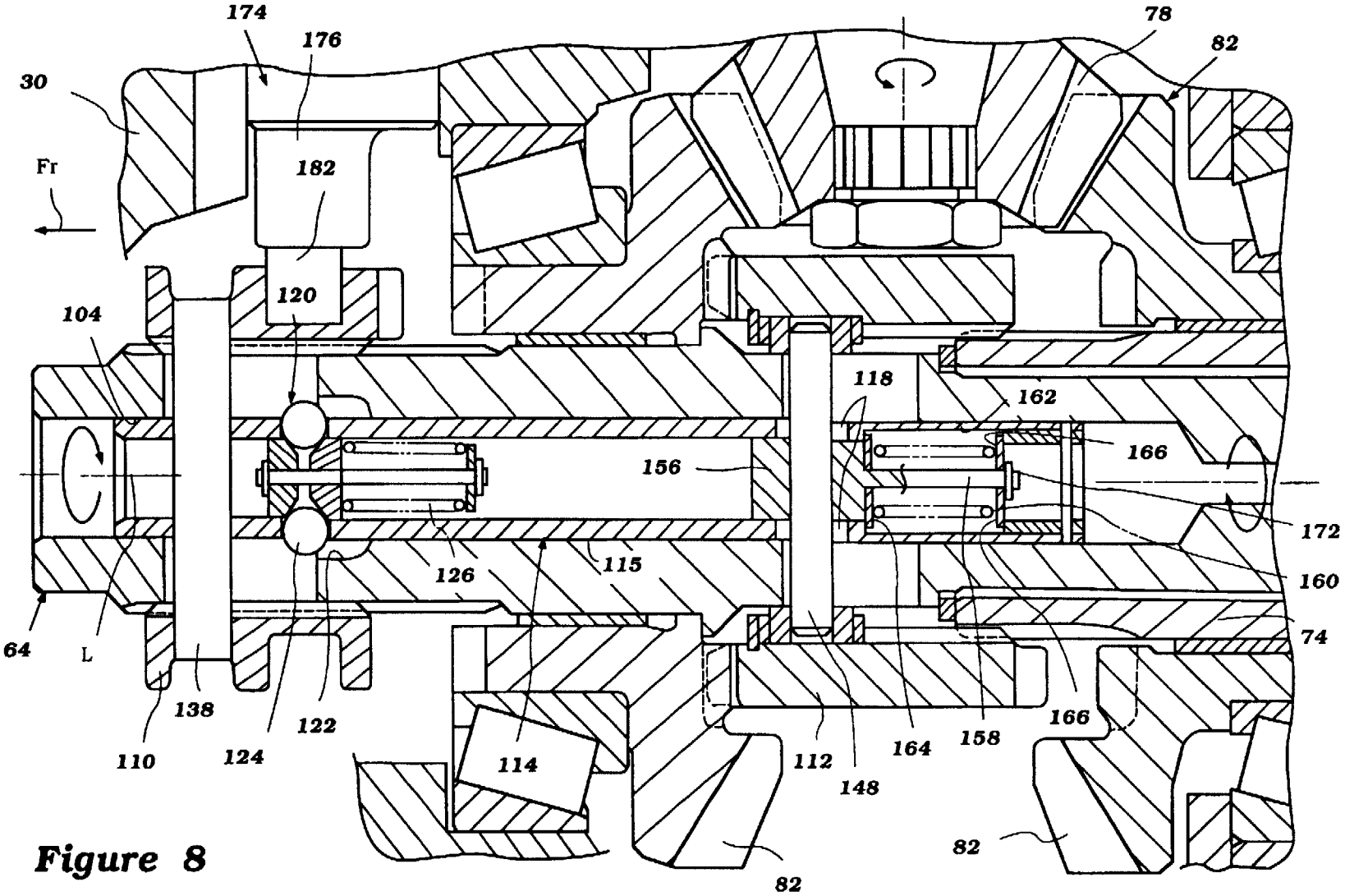
FIG. 8 is a sectional, side elevational view of the transmission of FIG. 7 with the transmission in the reverse drive condition.

With reference to FIG. 8, once the corresponding teeth 142, 90 of the rear clutch 112 and front gear 80 register, the front gear 80 and rear clutch 112 engage. So engaged, the front gear 80 drives the outer propulsion shaft 72 through the spline connection between the rear clutch 112 and the outer propulsion shaft 72. The outer propulsion shaft 72 thus drives the front propeller 50 (FIG. 2) in a direction which asserts a reverse thrust to propel the watercraft 14 in reverse.

Figure 9:
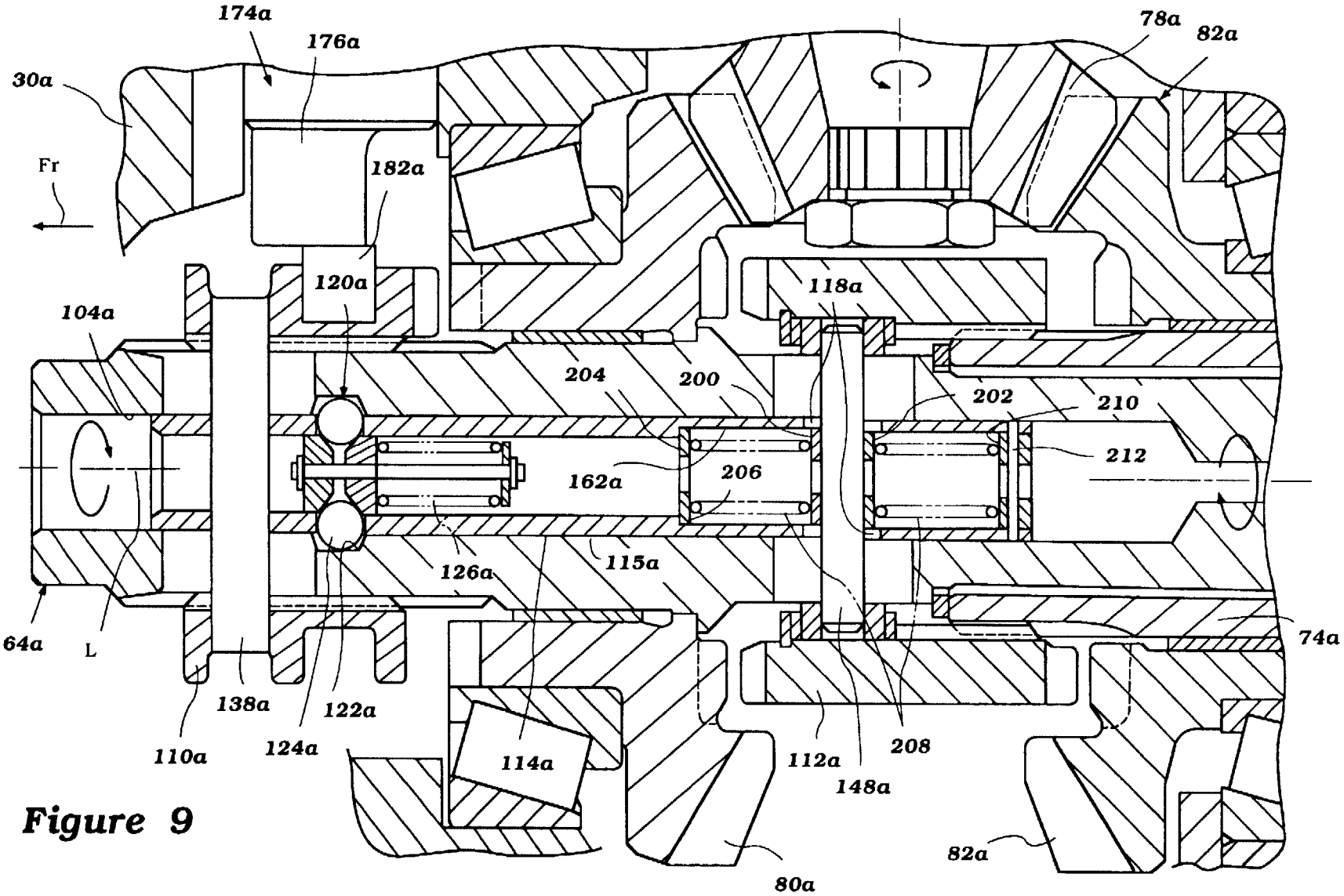
FIG. 9 is a sectional, side elevational view of a transmission for a marine drive which is configured in accordance with another embodiment of the present invention.
Figure 10:
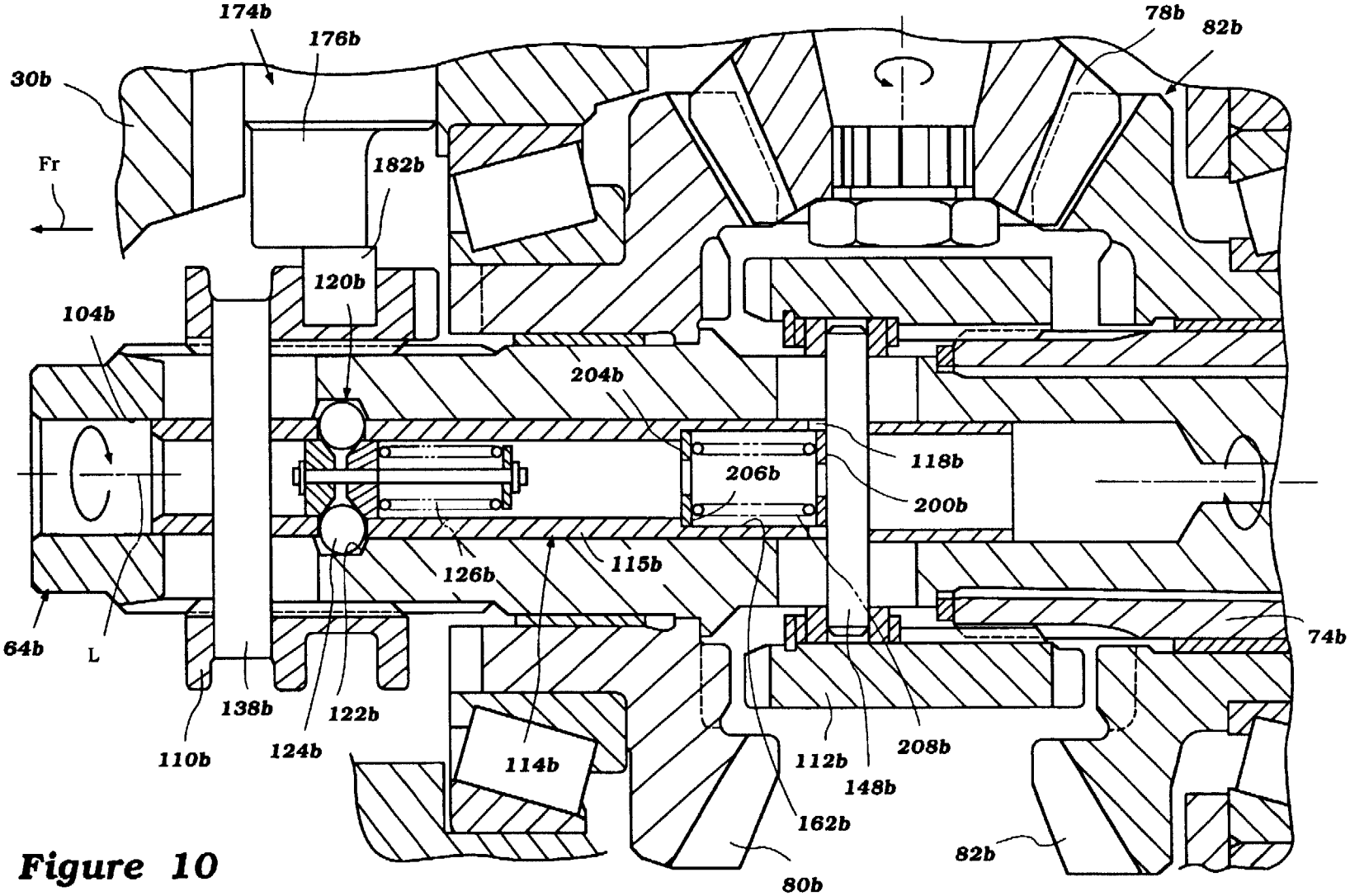
FIG. 10 is a sectional, side elevational view of a transmission for a marine drive which is configured in accordance with an additional embodiment of the present invention.

FIGS. 9 and 10 illustrate additional preferred embodiments of the present transmission with variations of the shift assistor mechanism. The embodiments illustrated by these figures, however, are otherwise identical to the transmission described above. Accordingly, the foregoing description of the transmission should be understood as applying equally to the embodiments illustrated in FIGS. 9 and 10, unless specified to the contrary.

FIG. 9 illustrates another embodiment of the present shift assistor mechanism which operated between the coupling pin (coupled to the rear clutch) and the plunger. Where appropriate, like reference numerals with an "a" suffix have been used to indicate like parts of the two embodiments for ease of understanding.

As seen in FIG. 9, the shift assistor mechanism **154*a* is disposed within a counterbore 162*a* of the plunger 114*a*. The counterbore 162*a* extends into the plunger 114*a* from a rear end of the plunger 114*a* and extends to a point forward of a pair of diametrically opposed guide slots 118***a* formed through the walls of the tubular plunger 114*a*.

A coupling pin 148*a* extends through the guide slots 118*a*. The ends of the coupling pin 148*a* are captured within a counterbore of the rear dog clutch sleeve 112*a* in the manner described above. The coupling pin 148*a* also is interposed between a pair of annular contact plates which are disposed within the counterbore 162*a* of the plunger 14*a*. A front plate 200 contacts one side of the coupling pin 148*a* and a rear plate 202 contacts the opposite side of the coupling pin 148*a*.

A stationary front plate 204 rests against a bottom step 206 formed by the counterbore 162*a*. A front spring 208 is contained within the counterbore 162*a* between the stationary front plate 204 and the front contact plate 200. The front plates 200, 204 hold the spring 208 in a preloaded condition to bias the front contact plate 200 against the coupling pin 148*a*.

On the opposite side of the coupling pin 148*a*, a second spring 208 is interposed between the rear contact plate 200 and a rear stationary plate 210. The rear stationary plate 210 has an outer diameter substantially equal to the diameter of the counterbore 162*a*. A pin 212, which passes through aligned transverse holes in the plunger 114*a* and the stationary plate 210, affixes the stationary plate 210 within the counterbore 162*a* of the plunger 14*a*.

The rear contact plate 202 and the stationary plate 210 hold the associated spring 208 in a preloaded condition. This biases the contact plate 202 against the coupling pin 148*a*. The preload force of the rear spring 208, however, desirably equals that of the front spring 208. In addition, the components of the shift assistor are configured to position coupling pin 148*a* normally at the center of the guide slots 118*a*. In this manner, the shift assistor 154*a* supports the coupling pin 148*a* in a manner which permits the coupling pin 148*a*, and thus the rear clutch 112*a* to move either forwardly or rearwardly, depending upon the direction in which the plunger 114*a* is attempting to move the rear clutch 112*a*.

FIG. 10 illustrates an additional embodiment of the present shift assistor which is substantially identical to the shift assistor illustrated in FIG. 9, except for the omission of the spring biasing mechanism on the rear side of the coupling pin. Where appropriate, like reference numerals with a "b" suffix have been used to indicate like components between the embodiments.

The shift assistor 154*b* is disposed within a counterbore 162*b* of the plunger 114*b*. The counterbore 162*b* extends to a point forward of the guide slots 118*b*. The coupling pin 148*b* extends through the guide slots 118*b*. The ends of the coupling pin 148*b* are coupled to the rear clutch 112*b* in the manner described above.

In the illustrated embodiment, a spring 108*b* biases the coupling pin 148*b* against the rear end of the guide slots 118*b*. The spring 208*b* is contained within the counterbore 162*b* of the hollow plunger 114*b* on the front side of the guide slots 118*b*. A front washer 204*b* and a rear washer 200*b* sandwich the compression spring 208*b* in a preloaded condition.

The front washer 204*b* rests against a bottom step 206*b* formed by the counterbore 162*b*. The spring 208*b*, thus, biases the rear washer 200*b* into contact with the coupling pin 148*b*. The shift assistor mechanism 154*b*, thus, supports the coupling pin 148*b* in a manner which allows the coupling pin 148*b* to move in the forward direction when engaging the rear clutch 112*b* with the rear gear 82*b*. As noted above, this yieldably coupling permits relative movement between the plunger 114*b* and the rear clutch 112*b* to allow the clutches 110*b*, 112*b* to separately engage the corresponding gears 80*b*, 82*b*.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A transmission for a watercraft outboard drive which selectively couples a drive shaft of the outboard drive to first and second propulsion shafts, each propulsion shaft extending from said transmission to drive a propulsion device, said transmission comprising first and second counter-rotating gears driven by said drive shaft, a first clutch coupled to said first propulsion shaft on a side of the first and second gears opposite of the propulsion devices, and a second clutch coupled to said second propulsion shaft and interposed between said first and second gears, a shift plunger interconnecting said first and second clutches, and a shift assistor yieldably connecting said second clutch to said shift plunger, said shift assistor comprising a pair of biasing mechanisms and a coupling pin being rotatably coupled to said second clutch, said coupling pin being interposed between the biasing mechanisms to yieldably connect said second clutch to said shift plunger in either direction along an axis of the second propulsion shaft, said shift plunger having a tubular shape with a counterbore formed in one end, said biasing mechanisms of said shift assistor being disposed within said counterbore.

2. A transmission as in claim 1, wherein said shift plunger moving said first and second clutches in a first direction to couple said first and second clutches with said first and second gears respectively, and in an opposite second direction to couple said second clutch with said first gear.

3. A transmission as in claim 1, wherein each biasing mechanism comprises a coil spring interposed between a pair of plates positioned within said shift plunger, and at least one of said plates is arranged to act against the coupling pin.

4. A transmission as in claim 3, wherein at least one of said plates is captured within a cavity formed within said shift plunger.

5. A transmission as in claim 1, wherein each biasing mechanism comprises a coil spring which acts against a contact plate, said contact plate being positioned within said plunger to contact at least a portion of said coupling pin.

6. A transmission as in claim 1, wherein said first and second propulsion shafts rotate about a common axis.

7. A transmission as in claim 1, wherein said first and second gears are bevel-type gears and said first and second clutches are positive clutches.

8. A transmission for a watercraft outboard drive which selectively couples a drive shaft of the outboard drive to at least one propulsion shaft, the transmission comprising first and second counter-rotating gears driven by the drive shaft, at least one clutch coupled to the propulsion shaft, a shift plunger having a tubular shape with a counterbore formed at one end, and a shift assistor yieldably connecting the clutch to the shift plunger, the shift assistor comprising a pair of biasing mechanisms and a coupling pin being rotatably coupled to the clutch, the coupling pin being interposed between the biasing mechanisms to yieldably connect the clutch to the shift plunger, the biasing mechanisms being disposed within said counterbore of said shift plunger and being arranged within the transmission to act against each other.

9. A transmission as in claim 8, wherein each biasing mechanism comprises a spring that acts against a contact plate, and the contact plate is positioned to contact at least a portion of the coupling pin.

10. A transmission as in claim 8, wherein the clutch is directly connected to the propulsion shaft.

* * * * *